US005341860A

United States Patent [19]

Klein

[11] Patent Number: 5,341,860

[45] Date of Patent: Aug. 30, 1994

[54] COVER SEAL UNIT, FOR AN AIR CONDITIONER HAVING A PERIPHERAL FRAME

[76] Inventor: Robert I. Klein, 1112 Park Ave., New York, N.Y. 10128

[21] Appl. No.: 104,575

[22] Filed: Aug. 11, 1993

[51] Int. Cl.[5] ..... A47B 81/00

[52] U.S. Cl. ..... 150/165; 52/202; 62/262

[58] Field of Search ..... 150/154, 165; 62/262, 62/296, DIG. 16; 312/100; 52/202

[56] References Cited

U.S. PATENT DOCUMENTS

| | | | |
|---|---|---|---|
| 2,714,546 | 8/1955 | Lesniak | 52/202 X |
| 2,992,668 | 7/1961 | Collard | 150/165 |
| 3,002,236 | 10/1961 | Humphner | 52/202 |
| 3,006,498 | 10/1961 | Thiede et al. | 312/100 X |
| 3,277,663 | 10/1966 | Ulich | 62/262 |
| 3,328,929 | 7/1967 | Mullins | 52/202 |
| 3,354,809 | 11/1967 | Orr et al. | 52/202 |
| 3,388,520 | 6/1968 | Perry | 52/202 X |
| 3,436,889 | 4/1969 | Jessee | 52/202 X |
| 4,202,389 | 5/1980 | Ewald | 150/165 |
| 4,221,091 | 9/1980 | Ganse et al. | 52/202 |
| 4,308,905 | 1/1982 | Gallagher | 150/165 |
| 4,325,229 | 4/1982 | DeZurik | 150/154 X |
| 4,325,594 | 4/1982 | Lang et al. | 312/100 |
| 4,332,114 | 6/1982 | Goebel et al. | 62/262 |
| 4,387,541 | 6/1983 | Boomershine | 52/202 |
| 4,389,827 | 6/1983 | Van Valkenburg | 52/202 X |
| 4,426,120 | 1/1984 | Johnson et al. | 312/100 |
| 4,625,784 | 12/1986 | Boroson | 150/165 |
| 4,759,194 | 7/1988 | Shapiro | 62/262 |
| 4,788,805 | 12/1988 | Shaw | 52/202 |
| 5,125,197 | 6/1992 | Fuchs | 62/262 X |

FOREIGN PATENT DOCUMENTS

| | | | |
|---|---|---|---|
| 4169723 | 6/1992 | Japan | 62/262 |

*Primary Examiner*—Sue A. Weaver
*Attorney, Agent, or Firm*—Bernard J. Murphy

[57] ABSTRACT

The inwardly-extending, peripheral frame of an air conditioner, exposed after the removal of the filter-enclosing cover thereof, grippingly receives U-shaped clamps thereon. The clamps have extending ledges to which are fixed upstanding studs. A cover, having a center recess, has outwardly extending flanges in which are formed slots. The studs are aligned with the slots and the cover is set thereover and wing nuts are tightened onto the studs to clamp the cover in place. The cover recess has a pad of resiliently compressible material fixed therein to prevent air drafts from passing through the air conditioner into the room into which the frame extends, and to dampen outside traffic noise, and other unwanted sounds.

14 Claims, 2 Drawing Sheets

FIG. 2
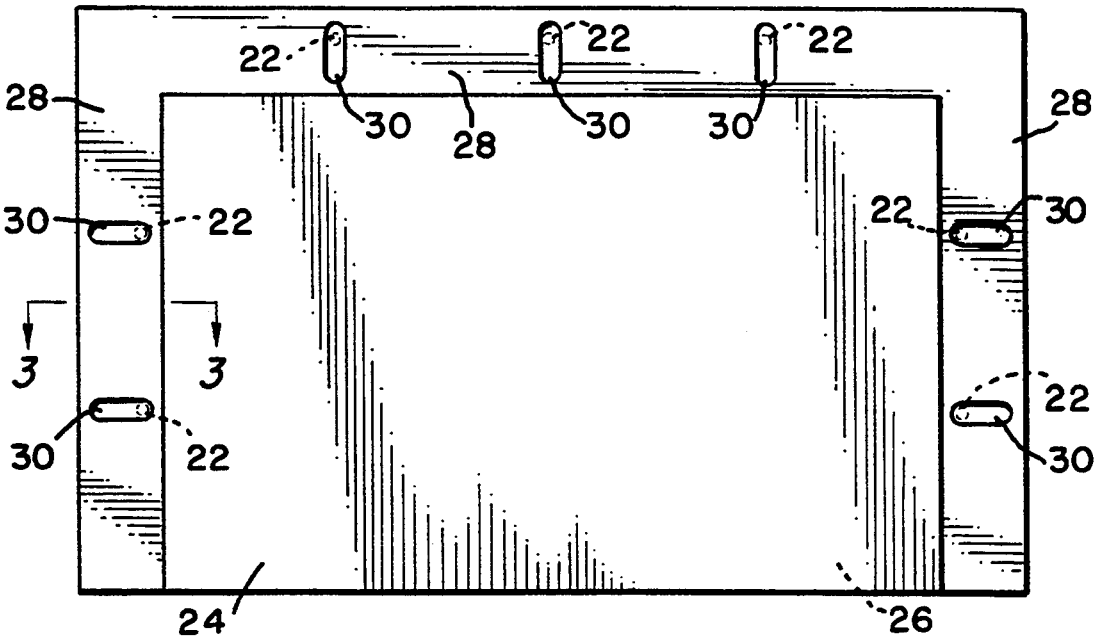
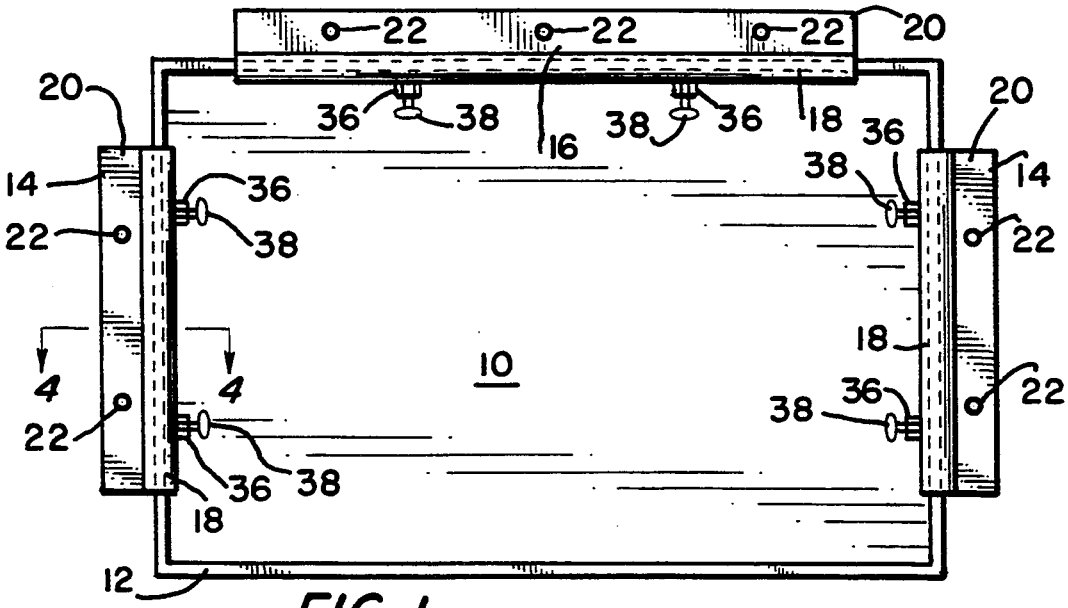
FIG. 1
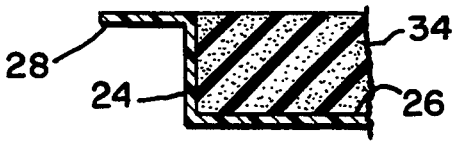
FIG. 3
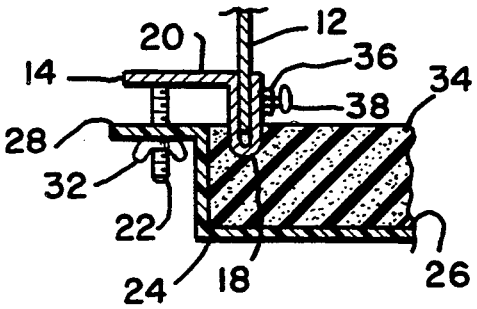
FIG. 4

COVER SEAL UNIT, FOR AN AIR CONDITIONER HAVING A PERIPHERAL FRAME

This invention pertains to cover seal units for air conditioners, such as are used when the air conditioners are not in use to close off the latter to prevent air flow drafts, and in particular to a novel cover seal unit, for an air conditioner having a peripheral frame, for enclosing and sealing off the air conditioner portion which projects inwardly of a dwelling or other building via a wall aperture or window frame.

Cover seal units for air conditioners which enwrap the external, outwardly-projecting portion thereof are well known. The simplest of these comprises flexible, usually thermoplastic sheets of material with draw strings, or the like, for enshrouding that portion of the air conditioner which extends from the dwelling or building exterior. They are not unsatisfactory, but they are not universally applicable. If one resides on the thirtieth floor of an apartment building, and an air conditioner extends out of a wall aperture, or even a window frame, it is virtually impossible to gain access, safely, to the outwardly-projecting portion thereof to seal it off with a cover seal.

A solution to the problem would be a cover seal unit which can be secured to the inwardly-projecting portion of the air conditioner. There are a few of such in the prior art, namely: U.S. Pat. No. 2,992,668, issued to Mary Collard, on Jul. 18, 1961, for an Appliance Cover, and U.S. Pat. No. 4,625,784, for an Indoor Air Conditioner Cover and System, issued to Bernard A. Borosom, on Dec. 2, 1986. Each is serviceable, but comprise compliant, plastic material which lacks durability. Too, while they offer means for inhibiting drafts, they have no means for dampening sound. Another relevant U.S. Pat. patent that issued to Marguerite Ewald, U.S. Pat. No. 4,202,389, on May 13, 1980, for an Air Conditioner Cover Assembly. This patent offers a more durable cover, however the latter must be used in association with an external cover section, i.e., a section which encloses the out-of-building portion of the air conditioner. Again, too, this patented Assembly presents no means for dampening outdoor traffic sounds, and the like.

It is an object of this invention to set forth a novel cover seal unit, for the in-building portion of an air conditioner which (a) inhibits drafts, (b) dampens outdoor sounds, (c) prevents the in-building ingestion of soot and particulate dirt, (d) reduces the energy consumption of whatever is the heat-energy source for the building, and (e) is adjustable to differently-sized air conditioners.

Particularly, it is an object of this invention to set forth a cover seal unit, for an air conditioner having a peripheral frame, comprising an imperforate cover; and means for slidably engaging the frame of an air conditioner; wherein said cover and said frame engaging means comprise means cooperative for clamping said cover to said frame engaging means.

Too, it is an object of this invention to disclose a cover seal unit, for an air conditioner having a peripheral frame, comprising an imperforate cover; and means for clasping therebetween portions of the frame of an air conditioner; wherein said cover and said clasping means comprise means for coupling said cover to said clasping means.

Further objects of this invention, as well as the novel features thereof, will become apparent by reference to the following description, taken in conjunction with the accompanying figures, in which:

FIG. 1 is an elevational view of the frame of an air conditioner to which are fixed clamps, the latter comprising a part of the invention according to an embodiment thereof;

FIG. 2 is a plan view of the cover, attachable to the clamps of FIG. 1;

FIG. 3 is a cross-sectional view taken along section 3—3 of FIG. 2;

FIG. 4 is a cross-sectional view taken along section 4—4 of FIG. 1;

Figure 5:
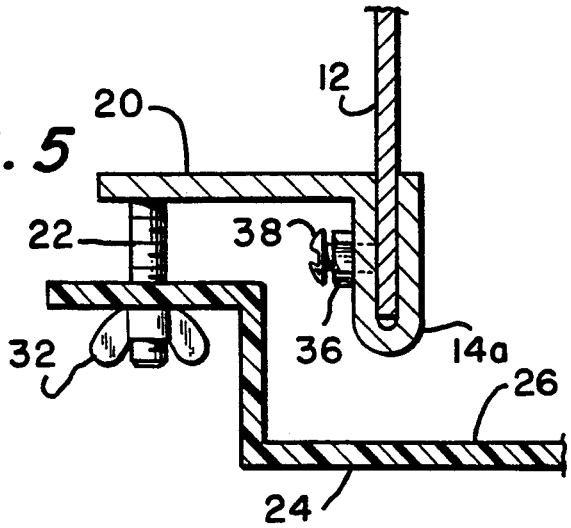
FIG. 5 is a cross-sectional view, similar to that of FIG. 4, depicting an alternate embodiment of the invention.

As shown in FIGS. 1 through 4, an air conditioner 10 (the inner, operating structure thereof not shown) comprises a frame 12. The view shown in FIG. 1 represents the inwardly projecting portion of the air conditioner 10 from which the removable, front grille cover has been removed. Thus, the peripheral frame 12 thereof is accessible. Clamps 14 and 16 are engaged with portions of the frame 12. Each clamp 14 and 16 comprises a U-shaped limb 18 and a ledge 20 extending from the limb 18. Each ledge 20 has a plurality of studs 22 extending therefrom in a normal attitude.

A foraminous cover 24, which has a recess 26 formed therein, has flat flanges 28 extending therefrom. The flanges have stud-receiving slots 30 formed therein, the same being so located as to accommodate the studs 22 therethrough. In FIG. 2, the studs 22 are shown in penetration of the slots 30, in phantom, to illustrate the studs 22 to slots 30 alignment.

With the clamps 14 and 16 engaged with the frame 12, the engagement being of a fast, clasping nature, the cover 24 is emplaced over the frame 12, while aligning the studs 22 and slots 30.

As can be appreciated, by the provisioning of slots 30 make it possible for the cover 24 to be fitted to an air conditioner having a longer frame, and/or to an air conditioner having a narrower frame; with particular reference to FIG. 2, it can be seen that the studs 22 at the ends of the frame 12 can be further outboard, and the studs 22 along the side of the frame 12 can be further inboard, and the cover 24 will be readily receivable thereon. Upon the cover 24 being set over the studs 22, then wing nuts 32 are used to fasten the cover 24 securely.

The recess 26 has secured therein a thick mat 34 of resiliently compressible material, such as foam rubber. Consequently, with the cover 24 fitted onto the frame 12, and fastened onto the studs 22 by the wing nuts 32, air drafts are fully prevented from passing through the air conditioner 10 into the room or office into which the frame 12 projects. Too, the mat 34 dampens outside noise, such as traffic sounds.

As noted, the clamps 14 and 16 effect a fast, clasping engagement with the frame 12. However, additionally, the limbs 18 have internally-threaded nuts 36 fixed to the innermost arm of the U-shape thereof, and the nuts 36 align with bolt holes formed in said inner arms. Consequently, thumb screws 38 can be used to fix the clamps 14 and 16 even more securely to the frame 12.

As explained, one has only to remove (and store) the air conditioner front grille cover (not shown) to expose the peripheral frame 12. Then it is a simple matter to set the clamps 14 and 16 in engagement with the frame, align the studs 22 with the slots 30 of the cover, place the cover 24 onto the studs 22, and tighten the cover 24 with the wing nuts 32. If and as necessary, the thumb screws 38 can be torqued tightly when emplacing the clamps 14 and 16.

The cover 24 is shown cross-sectioned to indicate plastic. However, this is exemplary. The cover 24 could be of metal construction, or wood. Simply, the cover material should be sturdy enough to receive the torquing of the wing nuts 32, and to draw the pad 34 firmly against the air conditioner 10. Clearly, also, the cover 24 can have a decorative face, such as a pictorial scene, or wood grain simulation (or real, if a wooden cover), and such.

Where the inner, operating structure of the air conditioner 10 too closely crowds the frame 12, so that the nuts 36 and thumb screws 38 can not be accommodated, the novel clamps can take the form shown in FIG. 5. Here, the clamp **14*a* has the nut 36 fixed to the outermost arm of the U-shape thereof, the latter arm having the bolt hole formed therein, to receive the fastener 38**.

Figure 6:
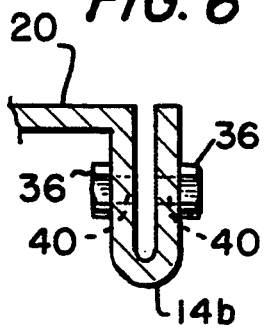
FIG. 6 is a cross-sectional view of an alternative embodiment of clamp.

To accommodate either aforesaid circumstance, the clamps can have both arms of the clamps with bolt holes formed therethrough and nuts fixed thereover. Such an embodiment of a clamp **14*b* is shown in FIG. 6, with the nuts 36 secured thereon over bolt holes 40**.

Figure 7:
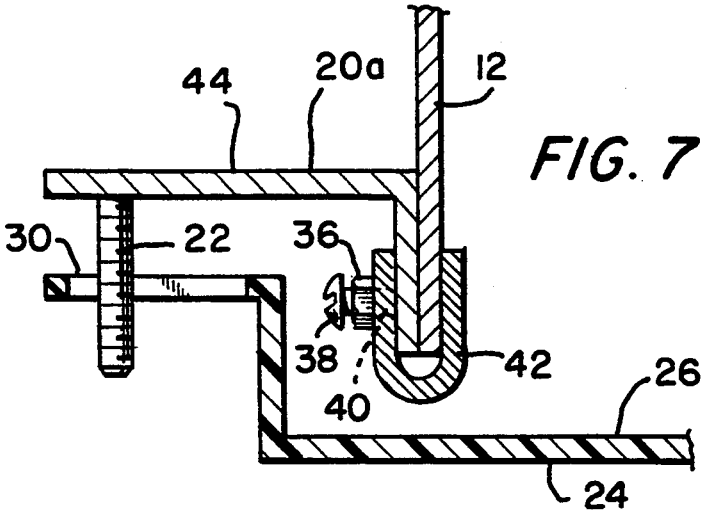
FIG. 7 is a cross-sectional view, similar to that of FIGS. 4 and 5, illustrative of yet another embodiment of the invention.

FIG. 7 depicts an alternative embodiment of the clamping means for fixing the cover 24 to the frame 12 of the air conditioner 10. Here, a U-shaped clip 42, having the nuts 36 and bolt holes 40, is used. The clip 42 has an inner access of sufficient width in which, tightly, to receive the frame 12 and an L-shaped member 44. The member 44 has a same ledge **20*a* to which are fixed the upstanding studs 22**.

Figure 8:
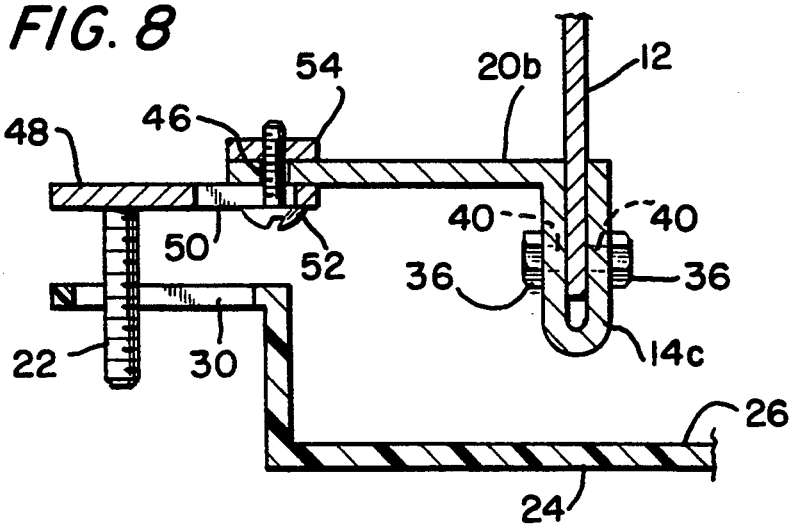
FIG. 8 is a cross-sectional view, similar to that of FIGS. 4, 5 and 7, illustrative of a still further embodiment of the invention.

It was priorly explained how the slots 30 facilitate the mating of the cover 24 to differently-sized air conditioners. The invention comprehends another adjustability for accommodating varying width and varying length air conditioners. As shown in FIG. 8, a U-shaped clamp **14*c*, having nuts 36 and bolt holes 40, has a ledge 20*b* with fastener holes 46 formed therein in adjacency to an end thereof. In addition, a flat link 48, having slots 50 formed therein, also in adjacency to the end thereof, is set over the holes 46. Then fasteners 52 are passed therethrough and fastened in a strip 54 which has threaded holes formed therein in which to torque the fasteners. As shown, the link 48 supports the studs 22 thereon. As can be readily appreciated, the novel cover seal unit, in its several embodiments, requires no complex installation, and only a screwdriver for its set up. Albeit not shown, the invention contemplates the use of a simple jig for ascertaining the optimum positioning of the clamps 14, 14*a*, 14*b*, 14*c*, 16, and clips 42, onto the frame 12 of the air conditioner 10. Too, while wing nuts 32 are depicted, clearly more decorative fasteners, attractively escutcheoned, perhaps, can be used to secure the cover 24 to the frame 12**.

It will be noted that the cover 24 has no flange 28 along one side thereof and, in FIG. 1, no clamp 16 is shown along one length of the frame 12. This is to accommodate the invention on through-window air conditioners. Omission of the flange at one side of the cover 24 will permit it to be fitted, securely onto the frame 12, and in flush, intimate engagement with the window sash. Self-evidently, for through-the-wall air conditioners, the invention comprehends slotted flanges fully about the cover 24, and clamps for both sides and ends of the frame 12.

While I have described my invention in connection with specific embodiments thereof, it is to be clearly understood that this is done only by way of example, and not as a limitation to the scope of the invention, as set forth in the objects thereof, and in the appended claims.

I claim:

1. A cover seal unit, for an air conditioner having a peripheral frame, comprising:

an imperforate cover; and means (a) for slidably engaging, and receiving therewithin, edge portions of the frame of an air conditioner, and (b) unyieldably fastening thereof to such edge portions; wherein said cover and said frame engaging means comprise means cooperative for securely attaching said cover to said frame engaging means.

2. A cover seal unit, according to claim 1, further including:

draft-inhibiting means fixed to said cover.

3. A cover seal unit, according to claim 1, further including:

sound-dampening means fixed to said cover.

4. A cover seal unit, according to claim 2, wherein:

said cover has a recess formed therein; and said draft-inhibiting means is fixed in said recess.

5. A cover seal unit, according to claim 3, wherein:

said cover has a recess formed therein; and said sound-dampening means is fixed in said recess.

6. A cover seal unit, according to claim 1, wherein:

said frame engaging means comprises fasteners for fastening said means to said frame.

7. A cover seal unit, according to claim 1, wherein:

said frame engaging means comprises a plurality of clamps; and each said clamp comprises (a) a U-shaped limb, and (b) a ledge extending substantially perpendicularly from said limb.

8. A cover seal unit, according to claim 7, wherein:

each said ledge has a stud fixed thereto and extending therefrom perpendicularly; and said cover has apertures formed therein through which to receive said studs.

9. A cover seal unit, according to claim 8, wherein:

said apertures comprise elongated slots.

10. A cover seal unit, according to claim 7, wherein:

one arm of each said limb has a bolt hole formed therethrough, and an internally-threaded nut secured thereto in throughgoing alignment with said bolt hole.

11. A cover seal unit, for an air conditioner having a peripheral frame, comprising:

an imperforate cover; and means for slidably engaging the frame of an air conditioner; wherein said cover and said frame engaging means comprise means cooperative for clamping said cover to said frame engaging means;

said frame engaging means comprises a plurality of clamps;

each said clamp comprises (a) a U-shaped limb, and (b) a ledge extending substantially perpendicularly from said limb; and each arm of each said limb has a bolt hole formed therethrough, and an internally-threaded nut secured thereto in throughgoing alignment with said bolt hole.

12. A cover seal unit, for an air conditioner having a peripheral frame, comprising:

an imperforate cover; and means for clasping therebetween portions of the frame of an air conditioner; wherein said cover and said clasping means comprise means cooperative for coupling said cover to said clasping means;

said clasping means comprises a clamp having (a) a U-shaped limb, and (b) a ledge extending substantially perpendicularly from said limb; and said coupling means comprises a link; wherein said link and said ledge have means cooperative for coupling of said link to said ledge;

said coupling means comprises an aperture formed in said link in adjacency to an end thereof, and an aperture formed in said ledge in adjacency to an end thereof; and further including means in penetration of said apertures for adjustably fastening said link and ledge together.

13. A cover seal unit, according to claim 12, wherein:

one of said apertures comprises an elongate slot; and said fastening means comprises a bolt; and further including threadedly-apertured means for receiving said bolt therein and torquing said bolt firmly therein and against said link.

14. A cover seal unit, for an air conditioner having a peripheral frame, comprising:

an imperforate cover; and means for clasping therebetween portions of the frame of an air conditioner; wherein said cover and said clasping means comprise means cooperative for coupling said cover to said clasping means;

said clasping means comprises a clamp having (a) a U-shaped limb, and (b) a ledge extending substantially perpendicularly from said limb; and said coupling means comprises a link; wherein said link and said ledge have means cooperative for coupling of said link to said ledge;

said link has a stud fixed thereto and extending therefrom, perpendicularly; and said cover has an aperture formed therein through which to receive said stud.

* * * * *